US008166690B2

(12) United States Patent
Brundula et al.

(10) Patent No.: US 8,166,690 B2
(45) Date of Patent: May 1, 2012

(54) SYSTEMS AND METHODS FOR INDICATING PROPERTIES OF A UNIT FOR DEPLOYMENT FOR ELECTRONIC WEAPONRY

(75) Inventors: Steven N. D. Brundula, Chandler, AZ (US); Magne H. Nerheim, Paradise Valley, AZ (US); Milan Cerovic, Phoenix, AZ (US)

(73) Assignee: TASER International, Inc., Scottsdale, AZ (US)

( * ) Notice: Subject to any disclaimer, the term of this patent is extended or adjusted under 35 U.S.C. 154(b) by 828 days.

(21) Appl. No.: 12/113,077

(22) Filed: Apr. 30, 2008

(65) Prior Publication Data

US 2012/0039013 A1 Feb. 16, 2012

(51) Int. Cl.
*F41B 15/00* (2006.01)

(52) U.S. Cl. ..... 42/1.08; 42/84; 89/1.11; 361/232

(58) Field of Classification Search ..... 42/1.08, 42/84, 1.01, 106; 102/502; 361/262, 232; 119/908; 175/4.6, 4.55; 166/299
See application file for complete search history.

(56) References Cited

U.S. PATENT DOCUMENTS

| | | | |
|---|---|---|---|
| 3,523,538 | A | 8/1970 | Shimizu |
| 3,626,626 | A | 12/1971 | Blanc |
| 3,803,463 | A | 4/1974 | Cover |
| 4,162,515 | A | 7/1979 | Henderson |
| 4,253,132 | A | 2/1981 | Cover |
| 4,843,336 | A | 6/1989 | Kuo |
| 5,052,138 | A | 10/1991 | Crain |
| 5,142,805 | A | 9/1992 | Horne |
| 5,177,318 | A | 1/1993 | Martinez |
| 5,272,828 | A | 12/1993 | Petrick |
| 5,303,495 | A | 4/1994 | Harthcock |
| 5,452,640 | A | 9/1995 | Bovee |

(Continued)

FOREIGN PATENT DOCUMENTS

| | | |
|---|---|---|
| WO | WO94/03769 | 2/1994 |

(Continued)

OTHER PUBLICATIONS

T'Prina Technology, "Stun Guns—An Independent Report", 1994.

*Primary Examiner* — Benjamin P Lee
(74) *Attorney, Agent, or Firm* — William R. Bachand

(57) ABSTRACT

An electronic weapon may be used with a unit for deployment to cause skeletal muscle contractions in a human or animal target. The unit for deployment when electrically coupled to the electronic weapon, may include at least two electrodes, an indicator, and a propellant for deploying the electrodes to enable delivery, through the target, of a stimulus current to incapacitate the target by causing contractions of the skeletal muscles of the target. The indicator indicates, to the electronic weapon, indicia of a first property of the unit for deployment prior to operating the propellant, and indicia of a second property of the unit for deployment after operating the propellant. Another unit for deployment includes at least two electrodes, an indicator, and a stimulus signal generator, coupled to the electrodes to enable delivery, through the target, of a stimulus current to incapacitate the target by causing contractions of the skeletal muscles of the target. The indicator indicates, to the electronic weapon, indicia of a first property of the unit for deployment prior to operating the stimulus signal generator, and indicia of a second property of the unit for deployment after operating the stimulus signal generator.

29 Claims, 5 Drawing Sheets

U.S. PATENT DOCUMENTS 5,548,510 A 8/1996 Ebert
5,625,525 A 4/1997 Coakley
5,654,867 A 8/1997 Murray
5,675,103 A 10/1997 Herr
5,698,815 A 12/1997 Ragner
5,755,056 A 5/1998 Danner
5,834,681 A 11/1998 DuBay
5,925,983 A 7/1999 Toda
5,936,183 A 8/1999 McNulty
5,962,806 A * 10/1999 Coakley et al. ..... 102/502
6,053,088 A 4/2000 McNulty
6,211,907 B1 4/2001 Scaman
6,321,478 B1 11/2001 Klebes
6,357,157 B1 3/2002 Constant
6,360,468 B1 3/2002 Constant
6,408,905 B1 6/2002 Lee
6,412,207 B1 7/2002 Crye
6,431,044 B2 8/2002 Poole
6,523,296 B1 2/2003 Constant
6,564,687 B2 5/2003 Poole
6,587,046 B2 7/2003 Joao
6,636,412 B2 10/2003 Smith
6,823,621 B2 11/2004 Gotfried
6,856,238 B2 2/2005 Wootton
6,859,831 B1 2/2005 Gelvin
6,862,994 B2 3/2005 Chang
6,880,466 B2 * 4/2005 Carman ..... 102/502
6,898,887 B1 5/2005 Stratbucker
6,999,295 B2 2/2006 Watkins
7,014,301 B2 3/2006 Dentel
7,018,008 B2 3/2006 Tsujimoto
7,047,885 B1 5/2006 Crickenberger
7,057,872 B2 * 6/2006 Smith et al. ..... 361/232
7,065,915 B2 * 6/2006 Chang ..... 42/84
7,075,770 B1 7/2006 Smith
7,096,792 B1 * 8/2006 Carman ..... 102/502
7,152,990 B2 12/2006 Kukuk
7,234,262 B2 6/2007 Smith
7,313,871 B2 1/2008 Lines
7,631,452 B1 * 12/2009 Brundula et al. ..... 42/1.08
7,658,151 B2 * 2/2010 Genis et al. ..... 102/502
2003/0097776 A1 5/2003 Brosow
2005/0005806 A1 1/2005 Mace
2006/0120009 A1 6/2006 Chudy
2006/0207466 A1 9/2006 McNulty
2006/0225334 A1 10/2006 Kapeles
2007/0019358 A1 1/2007 Kroll
2007/0070573 A1 * 3/2007 Nerheim et al. ..... 361/232
2007/0070574 A1 * 3/2007 Nerheim et al. ..... 361/232
2007/0079538 A1 * 4/2007 Smith et al. ..... 42/1.08
2007/0081292 A1 * 4/2007 Brundula et al. ..... 361/232
2007/0081293 A1 * 4/2007 Brundula et al. ..... 361/232
2007/0086190 A1 4/2007 Kukuk
2007/0137470 A1 * 6/2007 Oertwig et al. ..... 89/28.05
2007/0188972 A1 * 8/2007 Nerheim et al. ..... 361/262
2007/0214993 A1 * 9/2007 Cerovic et al. ..... 102/502
2007/0283834 A1 12/2007 Chen
2007/0287132 A1 12/2007 LaMons
2007/0297116 A1 * 12/2007 Cerovic et al. ..... 361/232
2008/0010888 A1 * 1/2008 Nerheim ..... 42/1.08
2008/0047459 A1 * 2/2008 Novelli ..... 102/502
2008/0137260 A2 * 6/2008 Brundula et al. ..... 361/232
2008/0204965 A1 8/2008 Brundula
2008/0259520 A1 * 10/2008 Brundula ..... 361/232
2009/0180234 A1 * 7/2009 Smith et al. ..... 361/232
2009/0251311 A1 * 10/2009 Smith et al. ..... 340/539.13
2009/0323248 A1 * 12/2009 Brundula et al. ..... 361/232

FOREIGN PATENT DOCUMENTS

WO WO03/025492 3/2003
WO WO2005/024337 3/2005

* cited by examiner

SYSTEMS AND METHODS FOR INDICATING PROPERTIES OF A UNIT FOR DEPLOYMENT FOR ELECTRONIC WEAPONRY

FIELD OF THE INVENTION

Embodiments of the present invention relate to systems and methods for electronic weaponry.

BACKGROUND OF THE INVENTION

Conventional electronic weapons have an interface to accept a cartridge. When activated by the weapon, the cartridge deploys electrodes toward a target. The spent cartridge is removed manually and replaced with another cartridge for another activation with the same or a different target. Several conventional cartridge types, each type with a different range (e.g., length of wire-tethers for electrodes), have been developed to operate interchangeably with a conventional electronic weapon via this interface. Users of conventional electronic weapons are trained to accommodate several limitations of an electronic weapon. For example, a user must be aware of the type of cartridge presently installed at the interface because the electronic weapon is not aware. Further, the control functions of a conventional electronic weapon are not responsive to the status of a cartridge (e.g. ready or already fired).

It is desirable to reduce the extent of user training and the burden on an electronic weapon user with respect to being aware of the capabilities of the electronic weapon with various cartridges.

BRIEF DESCRIPTION OF THE DRAWING

Embodiments of the present invention will now be further described with reference to the drawing, wherein like designations denote like elements, and.

DETAILED DESCRIPTION OF THE PREFERRED EMBODIMENTS

Figure 1:
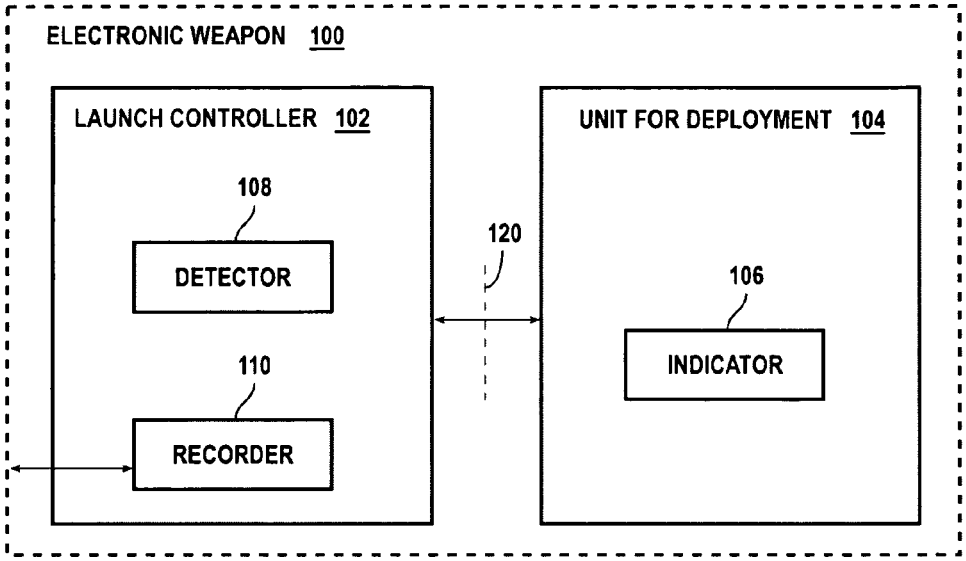
FIG. 1 is a partial functional block diagram of an electronic weapon with a unit for deployment, according to various aspects of the present invention.

An individual such as a police officer, a military soldier, or a private citizen may desire to interfere with the voluntary locomotion of a target (e.g., one or more persons or animals). Locomotion by a target may include movement toward and/or away from the individual by all or part of the target. An individual may desire to interfere with locomotion by a target for defensive or offensive purposes (e.g., self defense, protection of others, defense of property, controlling access to an area, threat elimination). For example, terrorists may be stopped in assaults and prevented from completing acts involving force to gain unlawful control of facilities, equipment, operators, innocent citizens, and law enforcement personnel. In another example, law enforcement officers may arrest and maintain the cooperation of persons by using an electronic weapon against that person or persons.

An electronic weapon includes any weapon that passes a current through a circuit that includes a target. A hand-held weapon (e.g., contact stun device, stun gun, baton, shield); a gun, an installation, a grenade, a mine, or an armed robot may shoot wire-tethered darts to form the circuit. A restraint device (e.g., an electrified belt, harness, collar, shackles, hand cuffs, patches) may be affixed to the target to form the circuit. All or part of an electronic circuit that provides the current may be propelled toward the target. A wireless projectile launched (e.g., by a gun, an installation, a grenade, mine, or an armed robot) toward the target may deploy electrodes that establish the circuit.

An electronic weapon when used against a target causes an electric current to flow through part of the target's tissue to interfere with the target's use of its skeletal muscles. Passing a current thought a target is referred to herein as stimulating the target; and the current is herein called a stimulus signal. Stimulating includes a local stun function where electrodes (also called terminals) fixed to the electronic weapon (e.g., a stun gun) are proximate to target tissue; a remote stun function where electrodes of the electronic weapon are launched away from the electronic weapon (e.g., connected by conducting tether wires); and/or a remote stun function where a projectile is launched away from the electronic weapon toward a target (e.g., no connecting tether wires).

When a terminal or an electrode is proximate to the tissue of the target, an arc may be formed in the air to complete a circuit for current to flow through the tissue of the target. The current may be delivered as a plurality of pulses. Each pulse interferes with the target's use of its skeletal muscles. A respective arc may be formed for each pulse or maintained for a series of pulses.

The current may be quantified in any conventional manner (e.g., average current over several pulses, pulses per second, average charge per pulse, average pulse duration). Electronic weapons of the type discussed herein may provide a stimulus signal that halts locomotion (as opposed to merely causing pain). A conventional stimulus signal of the type that halts locomotion has 5 to 20 pulses per second, from 50 to 500 microcoulombs per pulse, and from 10 to 500 microseconds current duration per pulse. Duration and charge measurements may be made between the points of 10% and 90% of peak amplitude of the current through a load (e.g., 400 ohms) substituted for a target.

The stimulus signal interferes with the target's voluntary control of its skeletal muscles in such a manner that the target, overwhelmed with pain does not move, or overwhelmed by the current cannot move its limbs. Consequently, the target may lose its balance, and may fall to the ground. Use of electronic weapons simplifies arrest of a target because the target is unwilling or preferably unable to resist arrest.

In operation, for example to stop a terrorist act, electrodes may be propelled from the electronic weapon toward the person to be stopped or controlled. After impact, a pulsing electric current of 5 to 20 pulses per second is conducted between the electrodes sufficient for interfering with the person's use of his or her skeletal muscles. Interference may include involuntary, repeated, intense, muscle contractions that may merge into continuous contraction.

A unit for deployment, according to the various aspects of the present invention, may include any materials for delivering a stimulus signal. One set of materials may be packaged as a cartridge. Several sets of materials may be arranged in a magazine or clip. Materials may include expendable materials (e.g., containers for propellant completely expended for a single delivery, non-reusable electrodes and tether wires). A unit for deployment may be packaged as a cartridge (e.g., comprising propellant and wire-tethered electrodes), electrified projectile (e.g., comprising a signal generator and deployed electrodes), and/or combinations thereof (e.g., a clip, a magazine). Functions of a unit for deployment include launching and stimulating as discussed above, and may further include describing the unit for deployment. Describing may include indicating a property (e.g., mechanical or electrical) of the unit for deployment at any time (e.g., the property being subject to change).

An electronic weapon, according to various aspects of the present invention, may accept one or more units for deployment (also called deployment units) and may include a launch controller that cooperates with the one or more units for deployment. The launch controller may communicate with the one or more units for deployment over a multipurpose interface (e.g., comprising a bus).

A unit for deployment that includes electrodes, tether wires, and a propellant system may be packaged as a cartridge for convenient ad hoc mounting on a launch controller to form an electronic weapon for a single remote stun use. After propelling the electrodes from the cartridge, the spent cartridge may be removed from the electronic weapon and replaced with another cartridge to be ready for another use of the electronic weapon against the same or a different target. Generally, but not necessarily, when a cartridge is removed from an electronic weapon, the stimulus signal is no longer delivered through the cartridge's electrodes. A cartridge may include several electrodes launched at once as a set, launched at various times as sets, or individually launched.

A magazine or clip, according to various aspects of the present invention, supports multiple uses of the electronic weapon on the same or different targets. A magazine may include an assembly of expendable materials, a plurality of cartridges, and/or a plurality of projectiles as discussed above. For example, an electronic weapon that for each use deploys a stimulus signal through one circuit typically including one target (e.g., one shot per use) may include a launch controller that independently controls the magazine for shots in series (e.g., one or more per trigger event) or for multiple shots (e.g., several concurrent shots and/or stimulations per trigger event) substantially simultaneously or in a sequence. The launch controller may communicate with the magazine using conductors unique to each use and/or conductors common to several uses.

A magazine according to various aspects of the present invention maintains materials for several uses (e.g. several trigger events) ready for use by the electronic weapon. For example, if a first attempted remote stun function is not successful (e.g., an electrode misses the target, the electrodes short together), a second set of materials (e.g., cartridge, projectile) may be ready for substantially immediate use (e.g., without operator intervention to mechanically adjust the electronic weapon and/or magazine).

It is desirable to identify to a launch controller the materials that are available for one or more uses of the launch controller prior to a next operation of the launch controller. It is also desirable to identify that no materials are available. Identification may be accomplished by detecting any property of the materials. A property includes an aspect of the materials that is detectible by an electronic weapon (e.g., physical size, physical shape, weight, electrical characteristics, temperature, and/or any operation of a deployment unit function). In the discussion that follows, materials for a single use are referred to as a cartridge for clarity. According to various aspects of the present invention, other electronic weaponry implementations of the structures and functions discussed herein may employ magazines and clips as discussed above that have materials not packaged as one or more mechanically separable cartridges.

Operation of a unit for deployment occurs when a function of a unit for deployment is performed. Particularly, operation of a cartridge occurs when a cartridge function is performed. Cartridges, according to various aspects of the present invention, operate by performing one or more of the following cartridge functions: launch, stimulate, provide information to be recorded, and describe available cartridge functions. Cartridge functions may be activated individually or in sets. Cartridge functions may be activated once per trigger event or in a series responsive to a trigger event. The performance of one function may start the performance of another function. Due to the limitations of the expendable materials, some functions may be performed once (e.g., launch), while other functions may be performed multiple times (e.g., stimulate, provide information, describe).

A describe function, according to various aspects of the present invention, provides to an electronic weapon access to a property of a unit for deployment as discussed above. An indicator may perform the describe function. The describe function may be conducted over an interface between a launch controller and a unit for deployment. By performing the describe function, information is conveyed across the interface. The launch controller may record the information conveyed.

The information may include indicia of: a present value of a property, a change of a value of a property, and/or a rate of change of a value of a property. For example, the property may be any of a resistance, a capacitance, an inductance, a resonance, a polarity, or a digital value. The property may be indicated with respect to a reference (e.g., a ratio of resistances). The property may be a consequence of particular circuitry (e.g., a parallel combination of resistances, continuity). The property may be distributed in time (e.g., a serial code). The property may indicate proper installation or assembly (e.g., that a cartridge, projectile, magazine, or clip is properly coupled mechanically and/or electrically to the launch controller) or lack thereof (e.g., no materials ready for use). The property may convey information about any of a range of the unit for deployment (e.g., design length of tether wires), manufacturer, date of manufacture, status (e.g., ready, spent), and malfunction.

Performance of a function of a cartridge may modify a property of the cartridge. For example, launching electrodes from a cartridge may change an electrode present property of the cartridge from electrode present to electrode not present. Launching may modify an electrical impedance associated with a propellant, a tether wire, an electrode, a frangible circuit, a consumable material, a destroyed component, and/or a portion of a projectile.

According to the present invention, electronic weapons in cooperation with a unit for deployment achieve particular synergies. For example, in electronic weapons of FIGS. 1-10, a description of a property of the unit for deployment is conveyed across an interface for improved cooperation. Electronic weapon 100 of FIG. 1 includes launch controller 102, unit for deployment 104, and interface 120. Launch controller 102 includes detector 108 and recorder 110. Unit for deployment 104 includes indicator 106. Briefly, launch controller 102 detects information from unit for deployment 104 before, during, and/or after launch. Launch controller 102 controls functions of unit 104 as needed to accomplish a local stun and/or a remote stun as discussed above. Unit for deployment 104 may include structures for launching, stimulating, and describing. Launch device 102 may determine the properties (e.g., use, malfunction, range) of at least one and preferably all cartridges of the unit for deployment. Launch device 102 may determine these properties upon installation of unit for deployment 104 with, on, or in launch device 102.

A launch controller includes any apparatus that performs a launch function. A launch controller may propel wire-tether electrodes. A launch controller may propel all or part of a projectile. For example, a launch controller for a mine (e.g., area denial device) may launch wire-tethered electrodes. A launch controller for a weapon (e.g., electronic, electronic combined with conventional firearm) may launch wire-tethered electrodes and/or a projectile from the weapon. A trigger event that initiates a launch function may be initiated by a user of the launch controller (e.g., a manually operated trigger) or a target (e.g., a trip wire).

A detector includes any apparatus that detects a property of a unit for deployment. A detector may receive indicia of a property of a unit for deployment. For example, detector 108 may receive indicia conveyed across interface 120. Detector 108 may include a circuit that provides a voltage, a current, and/or a digital signal to cooperate with indicator 106. For example, when indicator 106 includes a resistance, detector 108 may supply a current to detect the resistance (e.g., measure resistance, detect presence of a resistance, determine a ratio of resistances, compare a resistance to a threshold).

Indicia of a property of a unit of deployment generally describe the unit for deployment. The description may indicate a type of the unit for deployment and/or an identifier of a particular unit for deployment. A type describes a group of items of that type, while an identifier describes one item having that identity. For example, a type may indicate a manufacturer, a model, a capability, a standard, a quality level, a period of time, or a combination of these descriptions. A condition for launching, deploying, driving, stimulating, communicating, recording, or a combination of these functions as discussed herein may be met by a type or by an identifier that matches the condition. A processor that receives from a sensor indicia of a type or of an identifier may conditionally control these functions. For example, transceivers may be addressable for competitive use of a communication medium (e.g., one or more channels). An address may be determined in whole or in part from indicia of an identifier.

A recorder includes any apparatus that records information about a use of electronic weapon 100. A recorder may record performance of functions by launch controller 102. For example, recorder 110 records information about a performance of a function by launch controller 102 and about a unit for deployment 104. Information from unit for deployment 104 may include a description (e.g., one or more properties) of unit for deployment 104. Recorded information may include any combination of time, date, location, operator ID, launch controller ID, use, malfunction, and/or battery capacity. Recorder 110 may record audio and video information. Recording may integrate the above information with audio or video information (e.g., subtitles). Recorder 110 cooperates with any conventional interface (e.g., USB, wireless network) to facilitate access to the information for review.

In another implementation, launch controller 102 does not include recorder 110 to decrease cost and complexity of launch controller 102.

An indicator includes any apparatus that provides information to a launch controller. An indicator may perform the describe function as discussed above. Indicator 106 includes any apparatus that provides indication of one or more properties of unit for deployment 104, as discussed above. An indicator cooperates with a launch controller for communication of indicia that convey information from the indicator to the launch controller. Information may be communicated in any conventional manner including sourcing a signal by the indicator or modulating, by the indicator, a signal sourced by the launch controller. Information may be conveyed by any conventional property of the communicated signal. For example, an indicator may include a passive electrical, magnetic, or optical circuit or component to affect an electrical charge, current, electric field, magnetic field, magnetic flux, or radiation (e.g., light) sourced by a launch controller. Presence (or absence) of the charge, current, field, flux, or radiation at a particular time or times may be used to convey information via an interface between a launch controller and an indicator. Relative position of the indicator with respect to a detector in a launch controller may further convey information. In various implementations, the indicator may include one or more of any of the following: resistances, capacitances, inductances, magnets, magnetic shunts, resonant circuits, filters, optical fiber, reflective surfaces, and memory devices.

An indicator according to various implementations includes any combination of the above technologies. An indicator may communicate using analog and/or digital techniques. When more than one bit of information is to be conveyed, communication may be in serial, time multiplexed, frequency multiplexed, or communicated in parallel (e.g., using multiple technologies, using multiple channels of the same technology).

The information indicated by an indicator may be communicated in a coded manner (e.g., an analog value conveys a numerical code, a communicated value conveys an index into a table in the launch device that more fully describes the meaning of the code). The information may include a description of a property of a cartridge and/or magazine, including for example, the quantity of uses (e.g., one, plural, quantity remaining) available from this cartridge (e.g., may correspond to the quantity of electrode pairs in the cartridge), a range of effective distance for each remote stun use, whether or not the cartridge is ready for a next remote stun use (e.g., indication of a fully spent cartridge), a range of effective distance for all or for the next remote stun use, a manufacturer of the cartridge, a date of manufacture of the cartridge, a capability of the cartridge, an incapability of the cartridge, a cartridge model identifier, a serial number of the cartridge, a compatibility with a model of launch device, an installation orientation of the cartridge (e.g., where plural orientations may be used with different capabilities (e.g., effective distances) in each orientation), a malfunction, and/or a use.

Use (e.g., performance of a function of a cartridge), according to various aspects of the present invention, may include a launch operation that deploys electrodes or propels a projectile. Deployment is conventionally accomplished by a sudden release of gas (e.g., pyrotechnic gas production or rupture of a cylinder of compressed gas). The force generated from the sudden release of gas propels at least one electrode away from the unit for deployment. The force may further modify a property of the cartridge. Detection of a modified property (e.g. value before and after, change of value, value above or below threshold) may indicate use.

An interface includes any apparatus that conveys information. For example, interface 120 conveys information between indicator 106 to detector 108. Interface 120 receives information in any form provided by indicator 106 and/or detector 108. For example, interface 120 may convey an electrical signal from detector 108 to indicator 106 and convey a modified version of the electrical signal from indicator 106 to detector 108. Interface 120 may further include mechanical functions (e.g., to position unit for deployment 104 against launch controller 102 for electrical contact, to position unit for deployment 104 proximate to launch controller 102 for wireless communication).

According to various aspects of the present invention, an electronic weapon may cooperate with a plurality of sets of expendable materials in a single unit for deployment. For example, electronic weapon 200 of FIG. 2 includes launch controller 202, magazine 204, and interface 220. Launch controller 202 includes detector 212 and recorder 214. Magazine 204 includes a plurality 205 of sets of materials for deployment comprising cartridge 206 and cartridge 208. Magazine 204 further includes indicator 210.

Interface 220 may perform all functions discussed above with reference to interface 120. Interface 220 may further position a particular cartridge with respect to launch controller 202 (e.g., sequentially aligning each unspent cartridge to communicate in turn with launch controller 202).

In operation, launch controller 202 detects information from magazine 204 before, during, and/or after launch of a cartridge. Communication between launch controller 202 and magazine 204 occurs via interface 220. Launch controller 202 controls functions of magazine 204 and/or each cartridge (e.g., all, a subset of groups, individually) as needed to accomplish local stun and/or, remote stun functions of the magazine.

An indicator may perform the describe function for a single set of expendable materials (e.g., a cartridge) or for a plurality of sets (e.g., cartridges). For example, indicator 210 performs the describe function discussed above with reference to indicator 106 for each of cartridges 205 of deployment 204. Indicator 210 may perform the describe function for cartridges serially or concurrently. The describe function may be performed for individual cartridges (e.g., 206 and 208 individually addressable), a next cartridge, or any suitable group of cartridges. One group of cartridges includes all cartridges of magazine 204 to indicate that no further use is available (e.g., all spent).

Indicator 210 may aggregate information. Indicator 210 may provide information via interface 220 upon performing the describe function or in a delayed manner that may require storage of information before transfer. Interface 220 may convey information in any manner discussed herein. For example, indicator 210 may incorporate any conventional memory technology.

Detector 212 and recorder 214 may perform the functions discussed above with reference to detector 108 and recorder 110 with suitable adaptations for access to the information provided by indicator 210.

A unit for deployment may perform a launch function, a stimulate function, and/or a describe function with respect to expendable materials. The performance of one of these functions may be a prerequisite to the performance of another of these function. Performance of a function of a unit for deployment may be controlled wholly or in part through an interface. A unit for deployment may include a cartridge that performs, inter alia, launch, stimulate, and describe functions.

A launch function includes any operation for launching an electrode and/or a projectile towards a target. A launch function propels all or part of a unit for deployment toward a target to provide a current through the target. A launch function may be initiated by a launch controller, a user, and/or a target as described above. A launch function may ignite a propellant and/or start a rapid expansion of gas (e.g., as described above). A launch function may further include a function to deploy electrodes from a projectile toward a target and/or initially away from a target.

A stimulate function includes any operation for providing a current through a target. The current may be provided as a series of pulses of electric current. The stimulate function may provide pulses of current at a rate of 5 to 20 pulses per second. A stimulate function may provide any number of series of pulses where each series comprises any number of pulses. A stimulate function may include ionization where an arc ionizes air in a gap to establish a low resistance path for current delivery through the target.

A describe function includes any operation for providing indicia of a property, as described above, of a cartridge, a magazine, and/or a projectile. A describe function may detect properties of a unit for deployment.

An interface provides communication between functions. An interface provides communication for any function and/or apparatus directly or indirectly coupled to the interface. An interface for a unit for deployment may further provide mechanical functions for positioning as discussed above.

Figure 3:
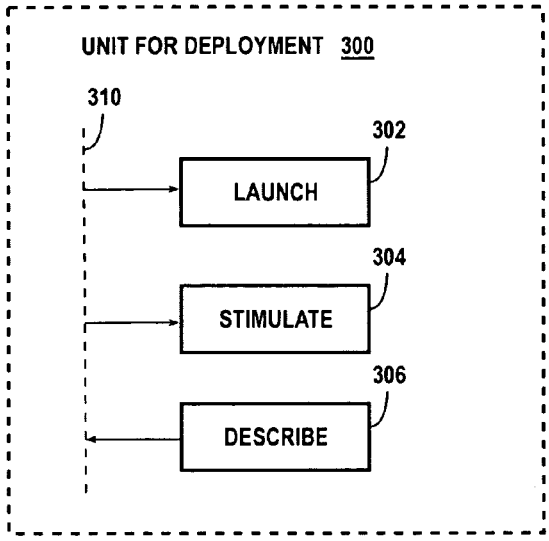
FIG. 3 is a partial functional block diagram of the unit for deployment of FIG. 1 or 2.

For example, cartridge 300 of FIG. 3 performs launch function 302, stimulate function 304, and describe function 306. The functions of cartridge 300 may communicate via interface 310 with a magazine or with a launch controller. The functions may communicate information, status, and/or control messages between each other and with any other function that has access, directly or indirectly, to interface 310. For example, a launch controller may start performance of launch function 302 via interface 310. A trigger pull may start performance of stimulate function 304. A detector and/or indicator may communicate with describe function 306 via interface 310. Describe function 306 may provide information before, during, or after launch. Cartridge 300 may perform functions as needed to accomplish local stun and/or remote stun.

Figure 4:
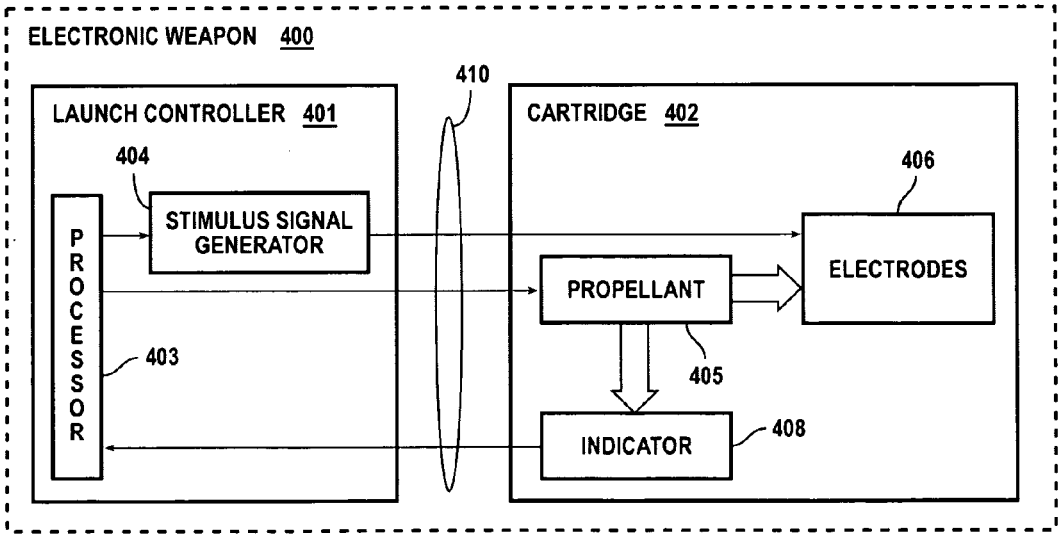
FIG. 4 is a partial functional block diagram of another electronic weapon with a unit for deployment, according to various aspects of the present invention.

Electronic weapon 400 of FIG. 4 is one implementation of an electronic weapon accordingly to FIGS. 1 and 3. Electronic weapon 400 includes launch controller 401 coupled to cartridge 402 by interface 410. Launch controller 401 includes processor 403 and stimulus signal generator 404. Cartridge 402 includes propellant 405, wire tethered electrodes 406, and indicator 408. Cartridge 402 is a unit for deployment packaged as a single shot replaceable cartridge (e.g., a round). Launch controller 401 uses one mounted cartridge 402 for each shot and can repeat remote stun stimulation with mounted cartridge 402 until mounted cartridge 402 is removed (e.g., dismounted) from launch controller 401.

Figure 2:
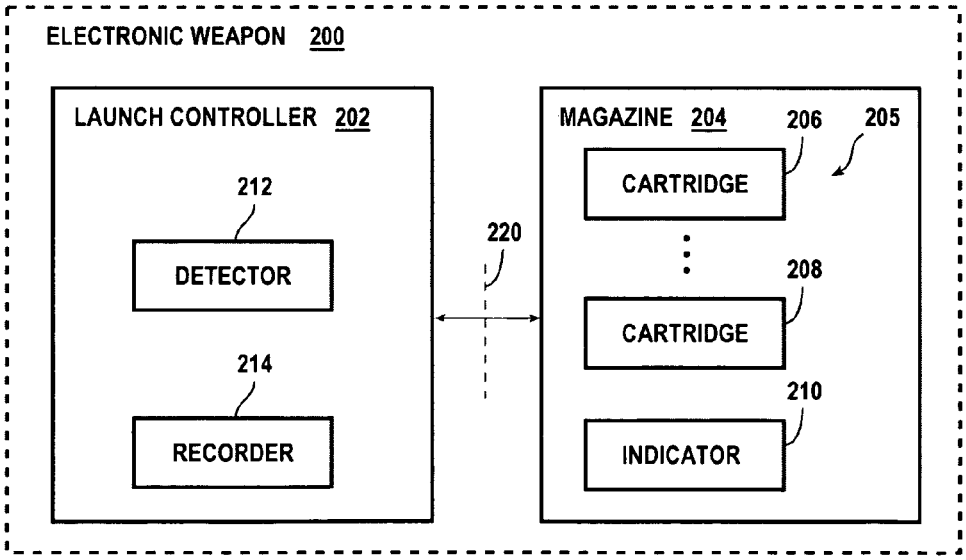
FIG. 2 is a partial functional block diagram of an electronic weapon with a magazine, according to various aspects of the present invention.

In another implementation, an electronic weapon is made and operates according to FIGS. 2, 3, and 4 with adaptations for multiple operations of the launch, stimulate, and describe functions, as discussed above. Each projectile is a unit for deployment packaged as a single shot replaceable round.

Propellant 404 performs launch function 302 to propel at least one electrode toward a target for forming a circuit through electrodes and target tissue. A launch controller, user, and/or target may begin performance of launch function 302 via interface 410 by activating operation of propellant 404. Stimulus signal generator 404 and at least one electrode 406 perform stimulate function 304 by providing a current through the target. Stimulus signal generator 404 may provide a stimulus signal that provides ionization and target stimulation as described above. Indicator 408 performs describe function 306. Indicator 408 detects a property of cartridge 402. Indicator 408 indicates, and processor 403 detects, indicia of the property via interface 410. Processor 403 initiates, determines, and/or controls performance of the launch, stimulate, and describe functions by executing instructions stored in memory that is part of processor 403.

A unit for deployment may include a projectile that performs the functions described above. For example, a projectile performs a stimulate function by providing a stimulus signal through a target hit by the projectile. The stimulate function of a projectile may also perform ionization. A projectile performs a launch function, or is affected by a launch function, by propelling all or part of the projectile toward the target. A portion of the projectile may remain with the launch controller. The projected portion is not tethered to the launch controller. An indicator detects properties of the projectile to perform the describe function. The functions of a projectile may communicate via an interface.

Figure 5:
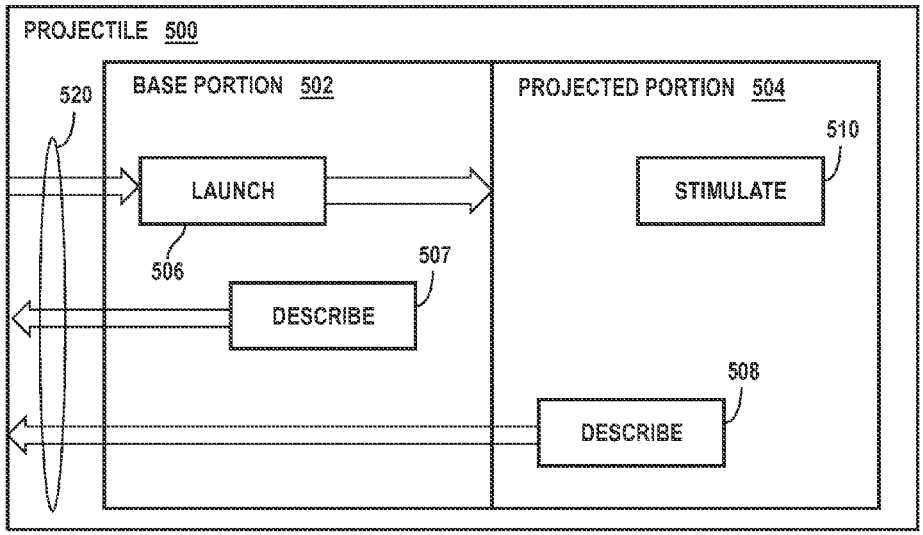
FIG. 5 is a partial functional block diagram of a projectile, according to various aspects of the present invention.

For example, projectile 500 of FIG. 5 is one implementation of a projectile according to FIGS. 1 and 3. Projectile 500 includes a base portion 502 and a projected portion 504. Base portion 502 performs launch function 302,506 and at least a portion of describe function 306, 507. Projected portion 504 performs stimulate function 306, 510 and at least a portion of describe function 306, 508. In operation, projectile 500 (as a unit for deployment 104, 204, 300) is placed in a suitable electronic weapon 100, 200. An electronic weapon may comprise a launch controller. Projected portion 504 is propelled toward a target by the launch controller 102, 202 initiating the launch function 506 of base portion 502. Base portion 502 may remain in the electronic weapon. After launch, projected portion 504 is not tethered to base portion 502, or the electronic weapon. The functions of projectile 500 may communicate via interface 520. The functions may communicate information, status, and/or control messages between each other and with any other function that has access, directly or indirectly, to interface 520. Describe function 507, 508 may describe properties of base portion 502, projected portion 504, or both portions. Describe function 507, 508 may provide information before, during, or after launch. Projectile 500 performs functions as needed to accomplish remote stun.

In one implementation of an electronic weapon that includes a launch controller and a projectile, the launch controller includes an interface coupled to interface 520 discussed above. Interface 520 may be implemented with any combination of electrical and mechanical interface technologies. For example, activating launch function 506 may be accomplished by conventional mechanical apparatus (e.g., a firing pin) or by an electrical circuit that passes a current through a propellant to ignite the propellant. The describe function in projectile 500 may be implemented using passive electrical components or components that receive current from the launch controller. For example, an indicator comprising a predetermined magnitude of resistance (e.g., implemented with one or more passive components) may perform the describe function where determining the resistance involves passing a current through the resistance, the current originating in the launch controller and conveyed across interface 520 to the indicator. For another example, an indicator comprising a memory device programmed with one or more values that describe the projectile may perform the describe function where reading the memory involves providing power and/or clocking currents to the indicator. Power and/or clocking currents may originate in the launch controller and be conveyed across interface 520 to the indicator. By providing current to the projectile, a battery power supply of the projectile need not be affected (e.g., turned on/off, drained) to perform the describe function.

The describe function 507, 508 may be performed before the launch function 506 and/or after launch the launch function 506 with suitable communication support to describe function 508 if performed after launch. In one implementation, describe function 508 cooperates with describe function 507 before launch and is not performed after launch. In another implementation, describe function 507 is omitted because describe function 508 performs its functions. In another implementation, describe function 508 is coupled to describe function 507 to reduce the complexity of interface 520 (e.g., both describe functions operate in parallel for one interface circuit, both describe functions operate in series for one interface circuit).

Figure 6:
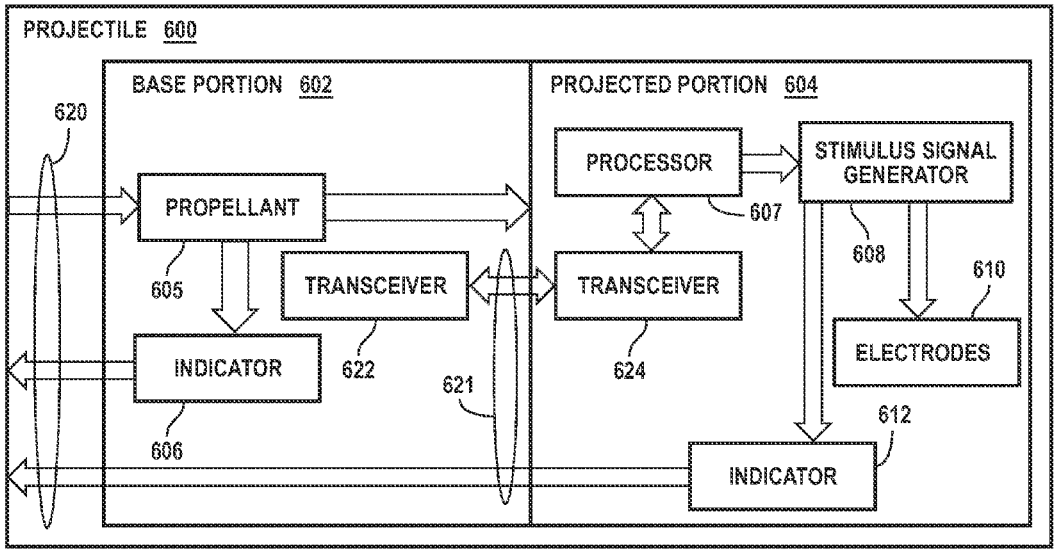
FIG. 6 is a partial functional block diagram of another projectile, according to various aspects of the present invention.
Figure 7:
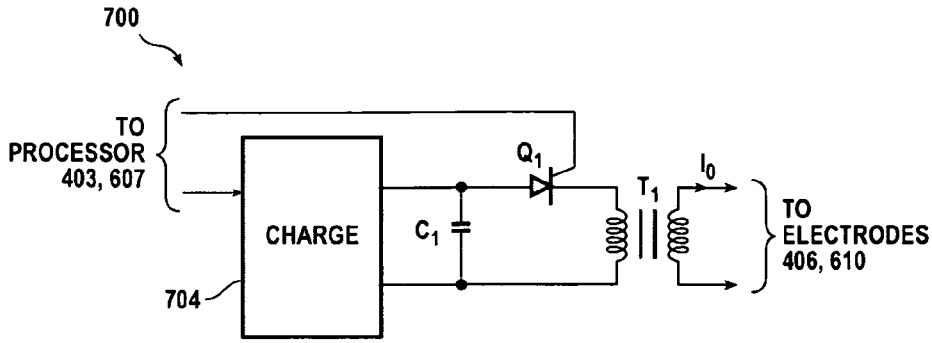
FIG. 7 is a simplified schematic diagram of a stimulus signal generator of FIG. 4 or 6.

Projectile 600 of FIG. 6 is one implementation of a projectile according to FIGS. 1, 2, 3 and 5. Projectile 600 performs functions as needed to accomplish a remote stun. Projectile 600 includes base portion 602 and projected portion 604 meeting at interface 621. Base portion 602 includes propellant 605 and of indicator 606. Projected portion 604 includes processor 607, stimulus signal generator 608, electrodes 610, and indicator 612. Propellant 606 performs launch function 506. Propellant 606, using methods described above, propels projected portion 604 away from base portion 602. Base portion 602 remains with the electronic weapon. Base portion 602 may accept and launch multiple projected portions 604; or base portion 602 may be single use. Projected portion 604 carries stimulus signal generator 608 and electrodes 610 toward the target. When projected portion 604 is proximate to and/or in contact with the target, stimulus signal generator 608 and electrodes 610 perform stimulate function 510 by providing a current through the target as discussed above. Indicators 606, 612 perform describe function 507, 508, inter alia, before performance of launch function 506. Indicator 606 may indicate properties of base portion 602. Indicator 612 may indicate properties of projected portion 604 to a launch controller. Before and during launch, indicator 612 may communicate with indicator 606 via interface 621.

Interface 621 may use conducted electrical signals or radiated electrical signals. After performance of launch function 506, indicator 612 may not communicate with indicator 606 via interface 621 because the separation of the base and projected portions may prohibit communication using conducted electrical signals. In another implementation, interface 621 includes wireless communication. After performance of launch function 506, indicators 606 and 612 may continue to communicate information, status, and/or control messages between electronic weapon 100, 200 and processor 607 via transceivers 622 and 624. Any low power directional wireless communication technology may be used. Transceiver 624 may be associated with a type and/or an identifier (e.g., a group address or a unique address) for communication with transceiver 622 and/or other transceivers within range.

Indicators 606, 612 may individually or collectively perform the describe function 507, 508 discussed above. For example, indicators 606 and or 612 may be omitted when the remaining indicator suitably performs the describe function. In one implementation, indicators 606 and 612 are serially connected and support a conventional $I^2C$ interface to a launch controller. In another implementation a passive circuit (e.g., one or more resistors) perform as an indicator prior to launching and, after launching, stimulus signal generator 608, processor 607, and transceiver 624 perform the describe function.

Processor 607 coordinates, initiates, determines, and/or controls performance of the stimulate and describe functions by executing instructions stored in memory that is part of processor 607. Processor 607 and stimulus signal generator 608 perform the functions discussed above with reference to processor 403 and stimulates signal generator 404 with adaptations for wireless remote stun by projectile 600 as opposed to wire-tethered remote stun by cartridge 402.

A stimulus signal generator may affect an indicator or a property monitored by the indicator. For example, an electronic weapon may include terminals (also called electrodes) (e.g., integral to the electronic weapon, packaged in a cartridge, packaged in a magazine) for pressing against target tissue to accomplish a local stun function. For each local stun function (also called drive stun or simply drive), the signal generator providing the current that passes through the target tissue may affect a property of the electronic weapon, cartridge, or magazine. The property may be altered in increments. An indicator the provides indicia of the altered value of the property may cooperate with a detector as discussed above to provide a record of the property (analogous to recorders 110 and 214). The alterable property may be implemented with analog or digital technologies including charged capacitors, analog counters, digital counters, analog memory, and/or digital memory.

A stimulus signal generator performs the stimulate function by delivering a stimulus signal. A stimulus signal generator performs ionization and/or stimulation by generating a suitable stimulus signal (or signals) as discussed above. For example, stimulus signal generator 700 of FIG. 7 responds to a processor to provide a current I0 through a target via electrodes. The current I0 causes contractions of skeletal muscles thereby interfering with locomotion by the target. Stimulus signal generator 700 includes charge circuit 704, capacitor C1, switch Q1 (e.g., an SCR or FET), and transformer T1. The structure and operation of charge circuit 704, switch Q1, transformer T1, electrodes, and a processor (e.g., 403, 607) may be of the type described in the following US patents and published patent applications incorporated herein by reference for all teachings regardless of the present context: U.S. Pat. No. 7,075,770, U.S. Pat. No. 7,145,762, U.S. Pat. No. 7,280,340, and WO2007/130895.

For example, charge circuit 704 charges capacitor C1 to a voltage (e.g., about 3000 volts) for storing energy for one output current pulse of M. At a time suitable for the desired pulse repetition rate (e.g., about 18 pulses per second), the processor (e.g., 403, 607) closes switch Q1 until capacitor C1 is completely discharged through a primary winding of transformer T1. Current through the primary winding of transformer T1 results in a step up voltage (e.g., about 50000 volts) across the secondary winding of transformer T1 and the electrodes. Current I0 flows in a circuit that includes the secondary winding of transformer T1, the electrodes, and tissue of the target and may further include one or more air gaps. Current I0 may be delivered at a voltage sufficient to form an ionized path across each gap to complete the circuit.

In an implementation for a projectile where, due to the force of impact of the projectile with the target, air gaps are not expected to exist, transformer T1 may be omitted. Charging circuit 704 may charge capacitor C1 to a stimulus voltage (e.g., about 450 volts) for electrodes that directly impact target tissue.

Charge circuit 704 delivers on each discharge a pulse of current I0 sufficient to deliver from about 50 to about 150 microcoulombs of charge to target tissue. Pulse width may be from about 10 to about 200 microseconds, preferably about 50 microseconds.

A processor includes any analog and/or digital circuitry for performing instructions stored in memory of the circuit, for conditioning input signals, and for providing output signals as discussed herein. A processor may respond to signals provided by a user and/or a target to determine that a trigger event has occurred. Output signals may activate an indicator, initiate a launch function, activate a deploy function, initiate a stimulus function, determine a stimulus function, and/or control a stimulus function.

A deploy/drive function includes a launch function 302 and/or a stimulate function 304 for local stun (drive) and/or remote stun (deploy) functions. An apparatus that performs a deploy/drive function is herein called a deploy/drive apparatus. A deploy/drive apparatus may be packaged as part of a unit for deployment (e.g., a cartridge, a projectile). A deploy/drive apparatus may include a propellant (405, 605) and may further include the object propelled (e.g., electrodes (406, 610) or a projectile (600)) as discussed above. A deploy/drive apparatus may include a processor and stimulus signal generator (e.g., as part of a projectile). A deploy/drive apparatus may further include electrodes (e.g., terminals for local stun, wire-tethered electrodes for remote stun, a deployed (launched) projectile having deployed electrodes for remote stun).

An electronic weapon combined with a deployment unit may include a processor and several circuits, according to various aspects of the present invention, for indicating, reading an indicator (e.g., detecting), and performing a deploy/drive function. An indicator may be implemented with electronic components that form a first circuit for reading (e.g., detecting) the indication. A second circuit may initiate performance (e.g., launch, deploy) of a deploy/drive function. A third circuit may provide a stimulus current through the target. The circuits may have components in common. The circuits may operate sequentially or concurrently. The operation of one circuit may be responsive to the operation of another circuit. The processor may coordinate, initiate, determine, and/or control the operation of the circuits. The processor may read information from an indicator. The processor may provide a current to perform a deploy/drive function.

Any electronic weapon, for example as discussed above with reference to FIGS. 1 through 7, may be implemented to include circuitry having a detector, indicator, and deploy/drive apparatus, according to various aspects of the present invention. Three examples follow. Particular synergies according to various aspects of the present invention are realized by a processor cooperating with an indicator before, during, and/or after invoking a deploy/drive function. A processor may, inter alia and in any practical order, detect the presence of a unit for deployment, detect a property in cooperation with an indicator, determine that the unit for deployment is ready for a deploy/drive function, determine that a trigger event has occurred, initiate a launch function in accordance with the property, and/or initiate, determine and/or control a stimulate function in accordance with the property. In each of the three examples, supply voltages V1 and V2 may have the same magnitude; however, preferably supply voltage V2 (e.g., about 12 volts) is greater than supply voltage V1 (e.g., about 3 volts).

Figure 8:
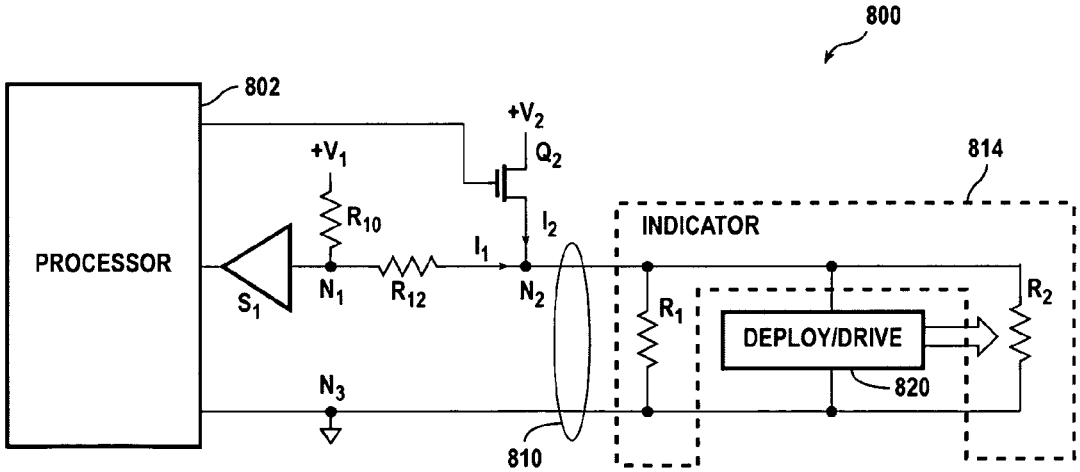
FIG. 8 is a simplified schematic diagram of a two-conductor interface between an electronic weapon and a unit for deployment according to various aspects of the present invention.

For a first example, circuitry 800 of FIG. 8 includes processor 802, sensor S1, resistor R10, resistor R12, switch Q2, indicator 814 comprising resistors R1 and R2, and deploy/drive apparatus 820. Indicator 814 and deploy/drive apparatus 820 may be packaged in a unit for deployment (e.g., a cartridge, magazine, projectile). Indicator 814 may be packaged in whole or in part in a base portion and/or projected portion of a projectile. When switch Q2 is off, current I1 flows in a first circuit that includes resistor R10, node N1, resistor R12, node N2, indicator 814, and deploy/drive apparatus 820. When switch Q2 is on, current I2 flows in a second circuit that includes switch Q2, node N2, resistor R12 and node N1 (when interface 810 is open) and further includes indicator 814 and deploy/drive apparatus 820 (when indicator 814 and deploy/drive apparatus 820 are coupled to interface 810). Resistor R12 between nodes N1 and N2 provides a path to test a failure of switch Q2, that is, Q2 conducting when nothing is coupled to interface 810.

In addition to the functions discussed below with reference to FIGS. 8, 9, and 10, processor 802 may in addition perform any combination of functions discussed above with reference to processors 403 and 607. In other words, the control and recording functions of launch controller 102, 202, the describe, launch, and stimulate functions of unit for deployment 300, and projectile 500 may be implemented suitably at least in part with processor 802.

Indicator 814 and/or deploy/drive apparatus 820 has an electrical resistance that is altered by the deploy/drive function. For example, the resistance of resistor R2 may be altered as a consequence of launching (e.g., propellant force opens R2 by destroying it, propellant heat damages R2) while resistor R1 is unaltered. The resistance of deploy/drive apparatus 820 may be relatively high so as to have relatively small effect on the parallel resistance of resistors R1 and R2. Altering the resistance of R2 may be achieved by locating resistor R2 so it is affected by a release of energy from deploy/drive apparatus 820. Resistor R1 may be located out of range of the release of energy (e.g., behind a shield). Altering and protecting may be accomplished by employing resistors R1 and R2 of suitable materials to be unaffected or affected respectively by the release of energy.

In operation, when switch Q2 is off, current I1 is sourced through resistor R10 and resistor R12 to interface 810. The voltage at node N1 is sensed by sensor S1 with reference to circuit ground at node N3. The voltage at node N1 is the result of a voltage divider having resistors R10 and R12 in the first leg, and the resistance across interface 810 in the second leg. Sensor S1 provides an analog output to processor 802. The output of sensor S1 indicates absence of circuitry coupled to interface 810 (e.g., I1 is zero); presence of an unaltered indicator and unaltered deploy/drive apparatus electrically coupled to interface 810; and presence of an altered indicator and/or altered deploy/drive apparatus at interface 810. When switch Q2 is on, current I2 is provided (on the same conductor through interface 810 as current I1) to activate a deploy/drive function, consequently altering indicator 814 and/or deploy/drive apparatus 820. Thereafter, with switch Q2 off, the output of sensor S1 indicates that the deploy/drive function altered indicator 814 and/or deploy/drive apparatus 820.

The passive portion of circuitry 800 (i.e., the load side of interface 810) has three paths in parallel. A first path includes resistor R1. A second path includes deploy/drive apparatus 820. A third path includes resistor R2. These three paths have node N2 in common. If the passive portion of circuitry 800 is removed from interface 810, the three paths would continue to have a node in common.

Figure 9:
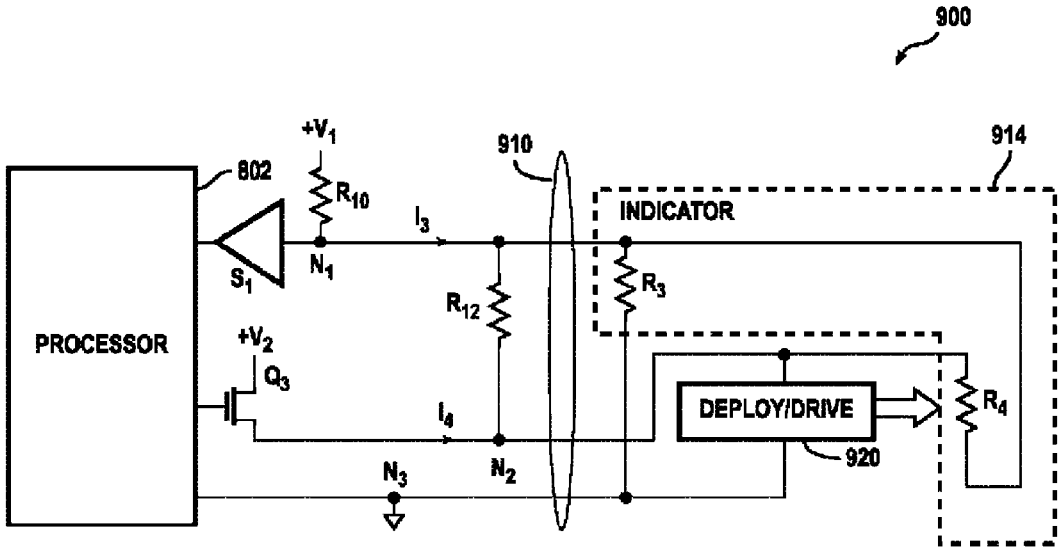
FIG. 9 is a simplified schematic diagram of a three-conductor interface between an electronic weapon and a unit for deployment according to various aspects of the present invention.

For a second example, circuitry 900 of FIG. 9 includes processor 802, sensor S1, resistor R10, node N1, resistor R12, node N2, switch Q3, indicator 914 comprising resistors R3 and R4, and deploy/drive apparatus 920. Indicator 914 and deploy/drive apparatus 920 may be packaged in a unit for deployment (e.g., a cartridge, magazine, projectile). Indicator 914 may be packaged in whole or in part in a base portion and/or projected portion of a projectile. Sensor S1, resistor R10, node N1, resistor R12, and node N2 operate with processor 802 as discussed above, except that node N1 (in addition to node N2) is available on a conductor through interface 910. When switch Q3 is off, current I3 flows in a branching first circuit that includes resistor R10, node N1, resistor R12, node N2, indicator 914 and deploy/drive apparatus 820. When switch Q3 is on and nothing is coupled to interface 910, current I4 flows in a second circuit that includes switch Q3, node N2, resistor R12, and node N1. When switch Q3 is on and indicator 914 and deploy/drive apparatus 920 are coupled to interface 910, most of current I4 flows through deploy/drive apparatus 920 and activates a deploy/drive function.

Indicator 914 and/or deploy/drive apparatus 920 has an electrical resistance that is altered by the deploy/drive function. For example, the resistance of resistor R4 may be altered as a consequence of launching (e.g., propellant force opens R4 by destroying it, propellant heat damages R4) while resistor R3 is unaltered. The resistance of apparatus 820 prior to the deploy/drive function may be relatively low so as not to affect the series resistance of resistor R4. Resistor R4 may limit the portion of current I3 that passes through deploy/drive apparatus 920 to avoid initiating the deploy/drive function in response to current I3. Preserving the resistance of resistor R3 and altering the resistance of resistor R4 may be achieved as discussed above with reference to resistors R1 and R2.

In operation, when switch Q3 is off, current I3 is sourced through resistor R10 and interface 910. The voltage at node N1 is sensed by sensor S1 with reference to circuit ground at node N3. Sensor S1 provides an analog output to processor 802. The output of sensor S1 indicates absence of circuitry coupled to interface 910 (e.g., I3 is zero); presence of an unaltered indicator and unaltered deploy/drive apparatus electrically coupled to interface 910; and presence of an altered indicator and/or altered deploy/drive apparatus at interface 910. When switch Q3 is on, current I4 is provided through interface 910 (on a conductor different from current I3) to activate a deploy/drive function, consequently altering indicator 914 and/or deploy/drive apparatus 920. Thereafter, with switch Q3 off, the output of sensor S1 indicates that the deploy/drive function altered indicator 914 and/or deploy/drive apparatus 920.

The passive portion of circuitry 900 (i.e. the load side of interface 910) has three paths. A first path includes resistor R3. A second path includes resistor R4 in series with deploy/drive apparatus 920. The first path is in parallel with the second path. A third path includes deploy/drive apparatus 920. The second and third paths have node N2 in common. If the passive portion of circuitry 900 is removed from interface 910, the second and third paths would continue to have a node in common.

Figure 10:
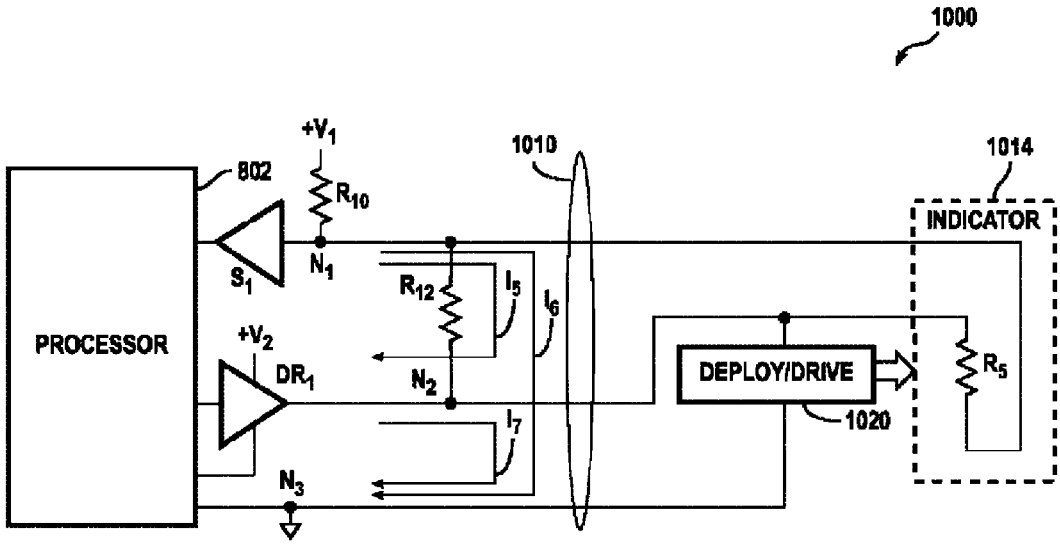
FIG. 10 is a simplified schematic diagram of another three-conductor interface between an electronic weapon and a unit for deployment according to various aspects of the present invention.

For a third example, circuitry 1000 of FIG. 10 includes processor 802, sensor S1, resistor R10, node N1, resistor R12, node N2, three-state switch (e.g., a tri-state driver) DR1, indicator 1014 comprising resistor R5, and deploy/drive apparatus 1020. Indicator 1014 and deploy/drive apparatus 1020 may be packaged in a unit for deployment (e.g., a cartridge, magazine, projectile). Indicator 1014 may be packaged in whole or in part in a base portion and/or projected portion of a projectile. When driver DR1 is sinking current and nothing is coupled to interface 1010, current I5 flows in a first circuit that includes resistor R10 node N1, resistor R12, node N2, and driver DR1. When driver DR1 is sinking current and indicator 1014 and deploy/drive apparatus 1020 are coupled to interface 1010, current I5 flows in a second branching circuit that includes resistor R10, node N1, resistor R12, indicator 1014 and driver DR1. When driver DR1 is off, current I6 flows in a third branching circuit that includes resistor R10, node N1, resistor R12, node N2, indicator 1014, and deploy/drive apparatus 1020. When driver DR1 is sourcing current, current I7 flows in a fourth circuit that includes node N2, driver DR1, and deploy/drive apparatus 1020.

Indicator 1014 and/or deploy/drive apparatus 1020 has an electrical resistance that is altered by the deploy/drive function. For example, the resistance of resistor R5 may be altered as a consequence of launching (e.g., propellant force opens R5 by destroying it, propellant heat damages R5). The resistance of apparatus 1020 prior to the deploy/drive function may be relatively low so as not to affect the series resistance of resistor R5. Resistor R5 may limit the current I6 to avoid initiating the deploy/drive function in response to current I6. Altering the resistance of resistor R5 may be achieved as discussed above with reference to resistor R2.

In operation, when driver DR1 is sinking current, current I5 is sourced through resistor R10 to interface 1010. The voltage at node N1 is sensed by sensor S1 with reference to circuit ground at node N3. Sensor S1 provides an analog output to processor 802. The output of sensor S1 indicates absence of circuitry coupled to interface 1010 (e.g., I5 is zero); and presence of an unaltered indicator 1014 electrically coupled to interface 1010; and presence of an altered indicator 1014 at interface 1010. When driver DR1 is off, current I6 is sourced through resistor R10 to interface 1010. The voltage at node N1 is sensed by sensor S1. Sensor S1 provides an analog output to processor 802. The output of sensor S1 indicates absence of circuitry coupled to interface 1010 (e.g., I6 is zero); presence of an unaltered indicator 1014 and/or unaltered deploy/drive apparatus 1020 electrically coupled to interface 1010; and presence of an altered indicator and/or altered deploy/drive apparatus 1020 at interface 1010. When driver DR1 is sourcing current, current I7 provided through interface 1010 activates a deploy/drive function, consequently altering indicator 1014 and/or deploy/drive apparatus 1020. Thereafter, with driver DR1 is sinking current, the output of sensor S1 indicates that the deploy/drive function altered indicator 1014; and with driver DR1 off the output of sensor S1 indicates that indicator 1014 and/or deploy/drive apparatus 1020 has been altered.

The passive portion of circuitry 1000 (i.e. the load side of interface 1010) has two paths. A first path includes resistor R5. A second path includes deploy/drive apparatus 1020. The first and second paths have node N2 in common. If the passive portion of circuitry 1000 is removed from interface 1010, the first and second paths would continue to have a node in common.

A comparison of the capabilities of the three examples of circuitry according to various aspects of the present invention is presented in Table 1. In the circuits compared in Table 1, deploy/drive apparatus 820, 920, and 1020 has a finite resistance before deployment that is altered after deployment. For convenience of explanation, the altered state of a deploy/drive apparatus is called open. In the implementations being compared, resistors R2 and R4 are altered by deployment, while resistors R1, R4, and R5 are not altered by deployment. For convenience of explanation, the altered state of a resistor is called open. In the circuits compared in Table 1, deployment does not remove the indicator and deploy drive apparatus from the interface. Resistance (high, medium, low) of deploy/drive apparatus 820 may respectively indicate spent, unusable, or ready. Threshold voltages suitable for comparisons for classifying conditions are subscripted with a T.

TABLE 1

| Row | Capability | Circuitry 800 | Circuitry 900 | Circuitry 1000 |
|---|---|---|---|---|
| 1 | Detect whether the initiator for a deploy/drive function is active when no deployment unit is installed, an unsafe condition if installing a deployment unit. | Due to R12, voltage at node N1 is $V_{T1}$ highest when Q2 is on and interface 810 is open; next highest $V_{T2}$ when Q2 off and 810 open; lower voltages when indicator 814 and deploy/drive apparatus 820 are coupled to interface 810. | Same as circuitry 800. | Same as circuitry 800. |
| 2 | Detect indicator is present and has suitable value before deploy/drive function is performed. | Analog voltages less than $V_{T2}$ at node N1 convey information coded to each voltage value within an upper range UR when R2 and/or 820 open; lower range LR when R2 and 820 intact. Values in ranges depend on resistance of R1. | Analog voltages less than $V_{T2}$ at node N1 convey information coded to each voltage value within an upper range UR when R3 and/or 920 open; lower range LR when R3 and 820 intact. Values in ranges depend on resistance of R4. | Using current I5, analog voltages less than $V_{T2}$ at node N1 convey information coded to each voltage value within a range MR. Values in range MR depend on resistance of R5. |
| 3 | Detect indicator after deploy/drive function. | After deployment alters (opens) 820 and/or R2, R1 creates voltage at node N1 in range UR instead of range LR. | After deployment alters (opens) 920 and/or R3, R4 creates voltage at node N1 in range UR instead of range LR. | Same as before deploy/drive function. |

TABLE 1-continued

| Row | Capability | Circuitry 800 | Circuitry 900 | Circuitry 1000 |
|---|---|---|---|---|
| 4 | Detect state of deploy/drive apparatus: unusable, ready, or spent. | Using current I1 < I2, analog voltage at node N1 depends on resistance of deploy/drive apparatus. Preferably I1 << I2. | Using current I3 < I4, analog voltage at node N1 depends on resistance of deploy/drive apparatus. Preferably I3 << I4. | Using current I6 < I7, analog voltage at node N1 depends on resistance of deploy/drive apparatus. Current I5 may be used to detect indicator without passing a current through the deploy/drive apparatus 1020. |
| 5 | Detect indicator without risk of initiating a deploy/drive function. | | | |
| 6 | Effect of part of indicator being altered by deploy/drive function. | Alteration affects entire range of voltage values at node N1 coded for values of resistance of R1. Coded values still convey information. | Alteration affects entire range of voltage values at node N1 coded for values of resistance of R4. Coded values still convey information. | After resistance of R5 is altered, coded values do not convey information except evidence that deploy/drive function has been performed. |

The circuitry of each of FIG. 8, 9, or 10 may be packaged in a deployment unit.

The circuitry of each of FIG. 8, 9, or 10 may be divided between an electronic weapon and a deployment unit where interface 120, 220, 520, or 620 is implemented at interface 810, 910, or 1010.

When a stimulus signal generator of a projected portion of a projectile is subject to repeated activation of the stimulus signal (e.g., a 30 second cycle of pulses) in response to radio control via a transceiver in the projectile (see generally FIG. 6), a summary record of all activations may not be available at the launch device that originally launched the projectile, at least because some of the commands to reactivate the stimulus (e.g., continue for a second or third 30-second cycle) may have originated at another transceiver (not shown). In such a case, an indicator of the projected portion of the projectile may provide a complete summary. The indicator may be affected by the stimulus signal generator of the projected portion. The indicator may be affected on each activation and reactivation of the stimulus signal generator. The summary may be retained in the projected portion (e.g. in the indicator or in a processor that detects the value of the indicator). The summary may be transmitted from the projected portion of the projectile (e.g., linking the indicator to the processor or the transceiver of the projected portion of the projectile).

The term "circuit" as used herein and in the claims is defined by the well known Kirchhoff's voltage law. Kirchhoff's law defines the sum of voltages in a closed circuit is zero. An open circuit or a portion of a closed circuit, also herein called a path or branch, is defined as part of a closed circuit. Parallel paths (branches) may be reduced by conventional analysis to an equivalent path to arrive at a circuit or path that does not include a branch. In other words, implementing a path or circuit with parallel components is an implementation of a path or circuit as claimed when the parallel components can be reduced to an equivalent component without changing the function or magnitude of the total current in the path or circuit.

A portion of an electrical circuit is "passive" if it consists of passive electrical components (e.g., resistors, capacitors, inductors) as opposed to switches (e.g., transistors, amplifiers, digital logic circuits). As used herein, an electrical circuit (or path) in a unit for deployment is also considered passive if it receives operative power (e.g., current) from a launch controller or electronic weapon.

The foregoing description discusses preferred embodiments of the present invention which may be changed or modified without departing from the scope of the present invention as defined in the claims. While for the sake of clarity of description, several specific embodiments of the invention have been described, the scope of the invention is intended to be measured by the claims as set forth below.

What is claimed is:

1. A unit for deployment for use with an electronic weapon when electrically coupled to the electronic weapon, the electronic weapon for causing skeletal muscle contractions in a human or animal target, the unit for deployment comprising:

at least two electrodes;

an indicator;

a propellant;

a first path comprising the electrodes, the first path for completing a first circuit in combination with the electronic weapon and the target;

a second path comprising the propellant, the second path for completing a second circuit in combination with the electronic weapon, the second circuit for operating the propellant to deploy the electrodes to enable the first circuit to deliver through the target a stimulus current to incapacitate the target by causing contractions of the skeletal muscles of the target; and a third path comprising at least a portion of the indicator, the third path for completing a third circuit in combination with the electronic weapon, the portion of the indicator indicates, to the electronic weapon and via the third circuit, indicia of a first property of the unit for deployment prior to operating the propellant, and indicia of a second property of the unit for deployment after operating the propellant.

2. The unit for deployment of claim 1 wherein the first property describes a type of the unit for deployment.

3. The unit for deployment of claim 2 wherein the indicator further indicates, to the electronic weapon, indicia of the type of the unit for deployment after operating the propellant.

4. The unit for deployment of claim 1 wherein the second property describes a use of the unit for deployment.

5. The unit for deployment of claim 1 wherein the electrodes are wire-tethered to the unit for deployment.

6. The unit for deployment of claim 1 wherein:

the unit for deployment further comprises a projectile comprising the electrodes; and operating the propellant propels the projectile.

7. The unit for deployment of claim 6 wherein the projectile further comprises a stimulus signal generator.

8. The unit for deployment of claim 1 wherein the portion of the indicator comprises a resistance in accordance with the first property that is altered, by operating the propellant, to provide the second property.

9. The unit for deployment of claim 8 wherein the resistance is increased toward an open circuit condition by operation of the propellant.

10. The unit for deployment of claim 1 wherein the third path further comprises the propellant.

11. The unit for deployment of claim 1 further comprising a fourth path comprising at least another portion of the indicator, wherein the fourth path is in parallel with the third path.

12. The unit for deployment of claim 1 wherein a current in the second path indicates that the propellant is inoperable.

13. The unit for deployment of claim 1 wherein the second path and the third path further comprise a common circuit component.

14. The unit for deployment of claim 1 wherein the indicator comprises at least two resistances coupled in parallel.

15. A unit for deployment for an electronic weapon, wherein the electronic weapon provides a first current and a second current to the unit for deployment, the electronic weapon for delivering via the unit for deployment a third current through a target to incapacitate the target by causing skeletal muscle contractions, the unit for deployment comprising:

a first path having a property that describes the unit for deployment, wherein the first path provides indicia of the property responsive to the first current; and a second path that receives the second current to perform a launch function of the unit for deployment, wherein after the launch function is performed, the property of the first path is altered and the unit for deployment delivers the third current through the target.

16. The unit for deployment of claim 15 wherein the property before being altered describes a type of the unit for deployment.

17. The unit for deployment of claim 15 wherein the property after being altered describes a use of the unit for deployment.

18. The unit for deployment of claim 15 wherein the first path is in parallel with the second path.

19. The unit for deployment of claim 18 wherein the first current provides indicia that the propellant is inoperable.

20. The unit for deployment of claim 15 wherein the first path and the second path have a node in common.

21. The unit for deployment of claim 15 further comprising a wire-tethered electrode for conducting the third current.

22. The unit for deployment of claim 15 wherein:

the unit for deployment further comprises an electrode; and the electrode is propelled, in response to the second current, toward the target for delivering the third current.

23. The unit for deployment of claim 15 wherein the second path further comprises a second property that describes the unit for deployment.

24. The unit for deployment of claim 15 wherein the first path and the second path have a component in common.

25. A unit for deployment for use with an electronic weapon when electrically coupled to the electronic weapon, the electronic weapon for causing skeletal muscle contractions in a human or animal target, the unit for deployment comprising:

at least two electrodes;

an indicator comprising at least two resistances coupled in parallel; and a stimulus signal generator, coupled to the electrodes to enable delivery, through the target, of a stimulus current to incapacitate the target by causing contractions of the skeletal muscles of the target; wherein the indicator indicates, to the electronic weapon, indicia of a first property of the unit for deployment prior to operating the stimulus signal generator, and indicia of a second property of the unit for deployment after operating the stimulus signal generator.

26. The unit for deployment of claim 25 wherein the first property describes an identity of the unit for deployment.

27. The unit for deployment of claim 25 wherein the indicator further indicates, to the electronic weapon, indicia of the first property of the unit for deployment after operating the stimulus signal generator.

28. The unit for deployment of claim 25 wherein the second property describes a use of the unit for deployment.

29. The unit for deployment of claim 25 wherein the indicator is altered, by operating the stimulus signal generator, to provide the second property.

* * * * *